United States Patent [19]

Blank

[11] Patent Number: 4,569,372

[45] Date of Patent: Feb. 11, 1986

[54] REMOTE VALVE OPERATORS

[75] Inventor: Leon W. Blank, Canfield, Ohio

[73] Assignee: Commercial Shearing, Inc., Youngstown, Ohio

[21] Appl. No.: 644,989

[22] Filed: Aug. 28, 1984

[51] Int. Cl.[4] ..... F15B 13/042

[52] U.S. Cl. ..... 137/625.66; 60/476

[58] Field of Search ..... 60/473, 474, 475, 476; 91/402; 137/625.66

[56] References Cited

U.S. PATENT DOCUMENTS

| | | | |
|---|---|---|---|
| 2,902,885 | 9/1959 | Wright | 74/625 |
| 3,058,038 | 10/1962 | Stedman, Jr. et al. | 317/177 |
| 3,408,035 | 10/1968 | Lathrop et al. | 251/14 |
| 3,409,036 | 11/1968 | Sherburne | 137/625.66 |
| 3,410,308 | 11/1968 | Moog, Jr. et al. | 137/625.61 |
| 3,500,380 | 3/1970 | Jessee | 340/347 |
| 3,590,873 | 7/1971 | Duff | 137/625.46 |
| 3,665,962 | 5/1972 | Dornseiffen | 137/624.13 |
| 3,789,876 | 2/1974 | Kempton et al. | 137/554 |
| 3,839,662 | 10/1974 | N'Guyen Van | 318/160 |
| 4,137,825 | 2/1979 | Leonard | 91/402 X |

FOREIGN PATENT DOCUMENTS

| | | | |
|---|---|---|---|
| 2095798 | 10/1982 | United Kingdom | 137/625.66 |

*Primary Examiner*—Gerald A. Michalsky

*Attorney, Agent, or Firm*—Buell, Ziesenheim, Beck & Alstadt

[57] ABSTRACT

A remote valve positioning apparatus is provided in which a valve spool is resiliently loaded at each end to a normal position, hydraulic fluid is delivered selectively to one end or the other of the valve spool at a fixed flow and the valve is positioned by pressure drop caused by the fixed flow over an orifice proportional to the stroke of the valve spool.

9 Claims, 5 Drawing Figures

REMOTE VALVE OPERATORS

This invention relates to remote valve operators and particularly to electric remote positioning of hydraulic elements such as valve spools.

The electric remote positioning of hydraulic elements such as valve spools has been practiced for some considerable time. As presently practiced remote positioning is accomplished by applying an axial force to the hydraulic element using various types of electro-magnetic force motors or solenoid devices. The manner in which such force is applied varies. The axial force may be applied directly to the element, as in U.S. Pat. Nos. 3,665,962 and 3,789,876, or it may be applied through a mechanical leverage arrangement such as a linkage or gear train as in U.S. Pat. No. 2,902,885, or it may be applied indirectly by valving a pilot pressure to the ends of the element or to a positioning cylinder connected to the valve element. In these latter cases the pilot pressure is generally obtained from a separate pump having a separate relief valve or unloader, or is taken from the main supply pressure through a pressure reducing valve or a pressure actuated unloading valve.

In the field of hydraulics, the term remote positioning applies generally to positioning a hydraulic element proportional to voltage (or current) of the electrical signal applied. Thus, if 50% of the rated voltage (or current) is applied, the hydraulic element is positioned 50% of its rated stroke and when 100% of the rated electrical signal is applied, the element is positioned at 100% of its rated stroke.

This proportioning position is accomplished by "feeding back" the element position to the electrical controller to balance out the command voltage (current input). Position feedback is normally accomplished electrically by use of a variety of electrical position transducers such as potentiometers, DCDT's, LVDT's, capacitances, induction devices, sonic devices or electro-magnetic devices. The transducer position signal is fed back to an analog or digital electrical black box, where it is compared to the input command signal, until the feedback signal matches the input signal.

The position of the element can also be fed back by hydraulic pressure by comparing the force applied to the element by the pressure command of the input signal to the force of a spring urging the element to its center position. The valve element position can also be fed back mechanically to the electrically controlled pilot positioner through a spring force that balances the input force commanded by the force motor (or proportional solenoid). In addition, there are other feedback arrangements combining mechanical valving and hydraulic pressure or flow to position the element. A broad category of these devices are referred to generally as "follow up" servos.

A special category of electric remote positioning of hydraulic elements is accomplished in a non-proportional manner referred to as "bang-bang" switching or ON/OFF devices. In this type of electric remote positioning, the hydraulic element is either positioned at center (off position) or full rated (100%) position. This is a special case of electric remote positioning in which a feedback device is not required, but the element is spring or hydraulically centered in the off position and driven against a stop in the on position. Some forms of positioning systems are illustrated in U.S. Pat. Nos. 3,058,038; 3,408,035; 3,410,308; 3,500,380; 3,590,873 and 3,839,662.

It is an object to provide a system capable of electrically remote positioning a hydraulic element either in a proportional or an ON/OFF mode as the operator desires.

It is another object of this invention to eliminate the need for a separate source of pilot pressure such as is commonly required in conventional systems.

It is still another object of this invention to provide a system which will eliminate or avoid the wear and backlash associated with prior art direct acting mechanical leverage arrangements such as gear trains and/or linkages.

It is another object of this invention to eliminate the stand-by flow required by traditional servo valve transducers such as nozzle flapper devices, jet pipe devices, jet deflector devices, etc., and still avoid the friction and direct sensitivity of sliding or rolling armature solenoid devices.

It is a further object of this invention to avoid the use of small fixed orifices which are subject to plugging by dirt and as a result, sending the hydraulic element to its full flow position in an uncontrollable manner, a relatively common problem in some prior art devices.

I have set out certain objects, purposes and advantages of this invention in the foregoing general statement. Other objects, purposes and advantages of this invention will be apparent from a consideration of the following description and the accompanying drawings in which.

Figure 1:
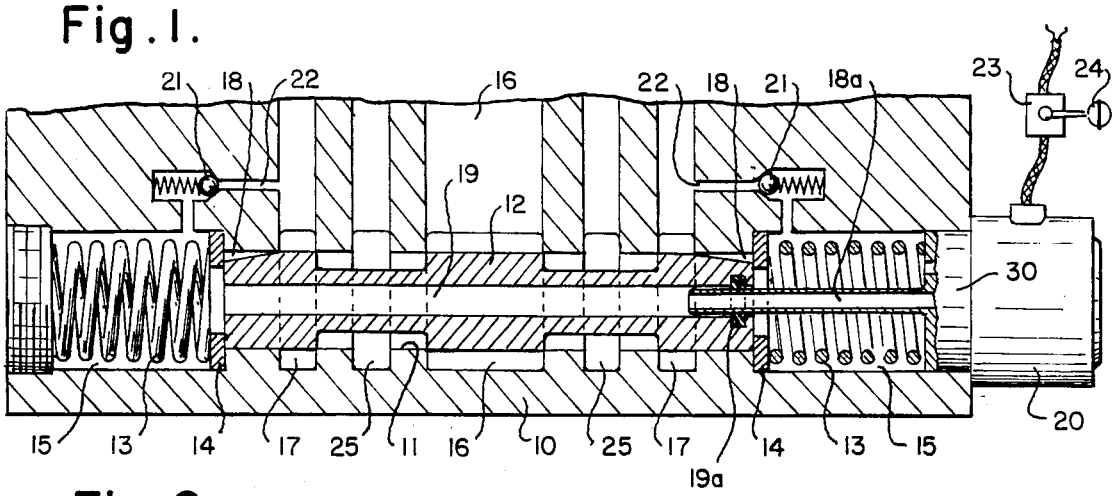
FIG. 1 is a section through a valve embodying the preferred structure of this invention.

Referring to the drawings, I have illustrated in FIG. 1 a preferred embodiment of this invention which provides a valve housing 10 having a longitudinal bore 11 carrying a valve spool 12 having detent centering springs 13 bearing on each end through detent rings 14 in enlarged cylindrical cavities 15 at each end of bore 11. The bore 11 is intersected at about its mid-point by a pressure chamber 16 and at spaced points on opposite sides of pressure chamber 16 by tank chambers 17. Intermediate the pressure chamber 16 and tank chambers 17 are work chamber 25. Each end of spool 12 is provided with a variable opening orifice 18, which is preferably a tapered slot, at each end communicating between one of tank chambers 17 and cavities 15 at each end of bore 11 when spool 12 is moved in either direction. One port of pump 30 is connected to the left cavity 15 by means of a line 19 passing through the axis of spool 12 and an elongate nozzle **18*a* on pump 30 which extends into line 19 and is sealed by seal 19*a* and is driven by an electric motor 20. The other port of pump 30 is directly connected to the right cavity 15. A pair of check valves 21 in lines 22 communicate between each of tank chambers 17 and the adjacent cavity 15. An electric controller 23 controls current going to motor 20. The position of electrical controller is governed by handle 24** which is manually positioned by the operator.

In operation the device operates as follows. With the electrical control handle in its center position, no voltage is applied to the motor and the spool 12 is centered by detent centering springs 13 bearing on ring 14, to its central no flow position.

As the operator moves the control handle 24 from its center position in either direction, a voltage proportional to the handle position is applied by the controller 23 to the electric motor 20. Typically, motor 20 is a permanent magnet motor whose speed is proportional to the voltage applied to its terminals. The motor 20 is thus caused to rotate in one direction or the other at a speed proportional to the voltage applied by the controller. In the case where the motor is caused to rotate in the direction to pump fluid from the right cavity 15 through passage 19 (viewing FIG. 1) hydraulic fluid is pumped from the right hand cavity 15 to the left hand cavity 15 causing the spool 12 to move to the right. As the spool moves to the right, fluid being pumped to the left area of the spool 12 begins to leak to tank through the variable orifice 18 formed by the tapered slot and the spool bore 11. The spool 12 continues to move to the right until the flow across this variable orifice, at the motor speed determined by the controller position, causes a pressure drop from the left cavity 15 to tank through left chamber 17, such that the force on the spool (spool area x pressure drop) is exactly equal to the opposing (centering) spring 13 force from the right plus flow forces on the spool metering edges. Fluid required by the pump 30 to prevent cavitation and overheating is drawn through right hand check valve 21 from the tank (not shown) to the right cavity 15.

The spool 12 stays in this new position until the control handle 24 is moved to another different position and the speed of the motor and consequently the flow of fluid from the pump is changed. If handle 24 is moved to the center position the motor stops rotating and the springs force the spool to return to center. Flow from the left chamber 15 returns to the tank through the variable orifice 18 and flow to the right chamber 15 is drawn from the tank through right hand tank chamber 17, passage 22 and check valve 21.

The spool 12 can be moved to the left by moving control handle 24 in the opposite direction from that described above, causing an opposite polarity voltage to be applied to the motor 20 rotating the pump 30 in the opposite direction to move the spool 12 to the left.

Figure 2:
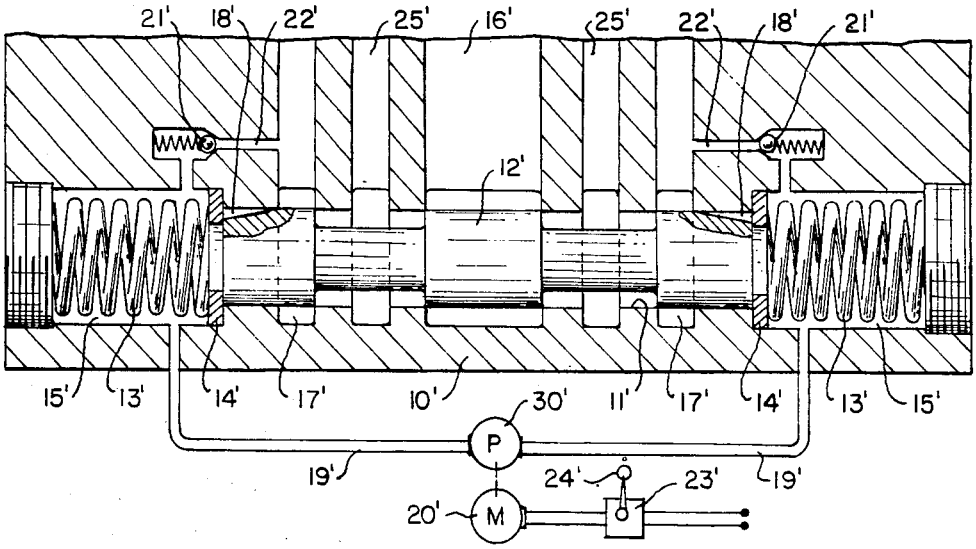
FIG. 2 is a section through a second embodiment of valve according to this invention.

In FIG. 2 I have illustrated essentially the same structure as that described above, with like parts bearing like numbers with a prime sign. The difference between the embodiment of FIG. 2 is that I use an external line 19' between cavities 15' at the ends of bore 11' and a separate motor 20' and pump 30' arrangement rather than the integral pump 30 and motor 20 of FIG. 1.

Figure 3:
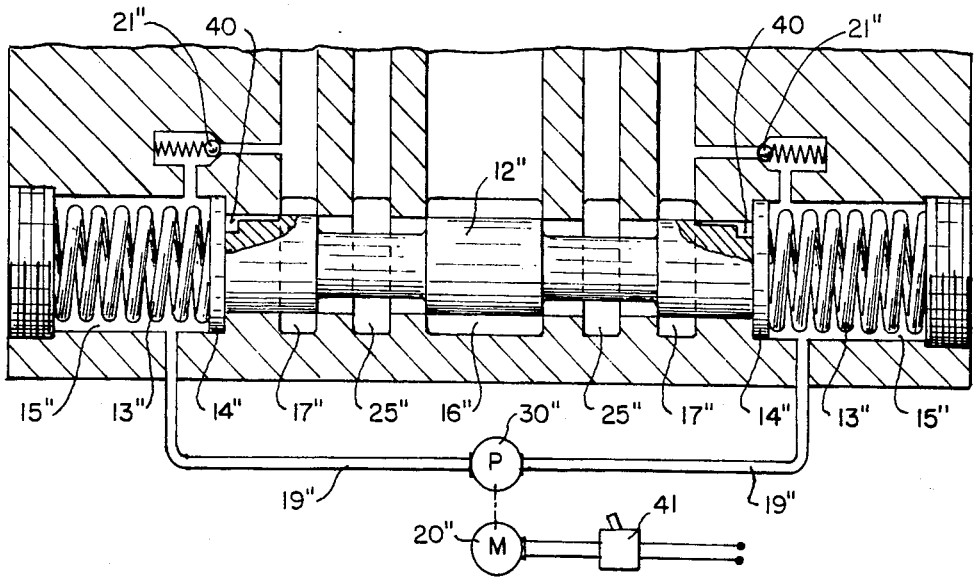
FIG. 3 is a section of a third embodiment of valve according to this invention.

In FIG. 3 I have illustrated an embodiment of the invention designed particularly for use in OFF/ON operation. Here again the structure is the same as that of FIG. 1 in most respects and like parts bear like numbers with a double prime sign. This embodiment differs from that of FIGS. 1 and 2 in the shape of slot 40 which is a stepped slot shaped such that flow from this area of the spool to tank is controlled by a smaller fixed opening until the spool is moved quickly to its full flow position where the slot changes abruptly to a larger opening rather than the variable orifice 18 of FIG. 1.

For ON/OFF use the controller 23 of FIG. 1 is replaced by a simple on/off switch 41 which applies full voltage to the motor in the on position and no voltage in the off position.

Figure 4:
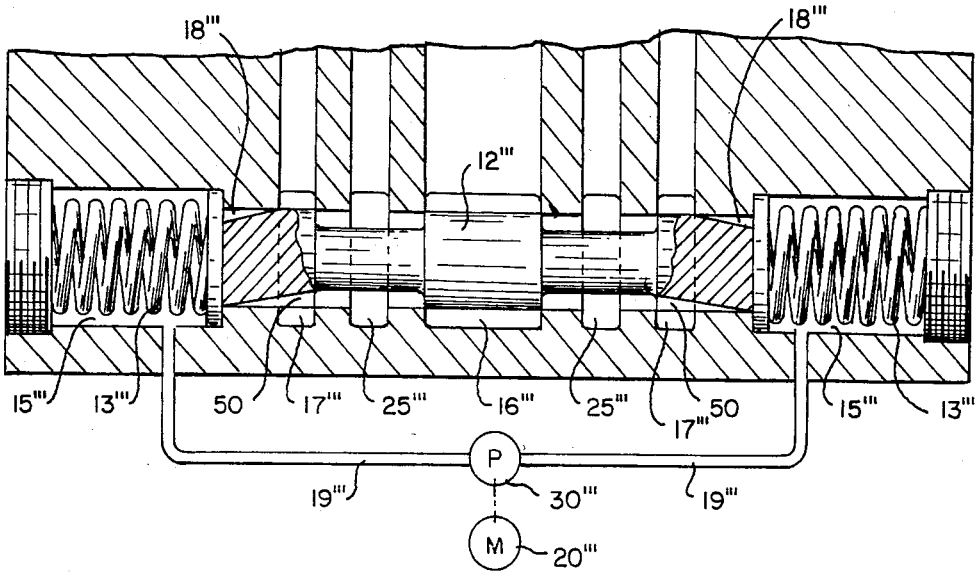
FIG. 4 is a section of a fourth embodiment of valve according to this invention.

In the embodiment of FIG. 4 I have illustrated a structure which is similar to that of FIGS. 1 and 2 with like parts bearing like numbers with a triple prime sign. The difference between this embodiment and that of FIG. 1 is that the check valves 21 and passages 22 have been replaced by a positive valving slot 50 in spool 12''' at each end. The size and shape of slot 50 may be varied to obtain different operational characteristics of the valve.

In the several embodiments illustrated I have used a closed center spool, however, it should be clear to men skilled in the art that it could be an open center spool or positioning actuator (cylinder) or any other kind of activating element.

Similarly while I have illustrated and described a permanent magnet motor in the several embodiments, the motor could be an AC or DC motor, either fixed speed for ON/OFF operation as in FIG. 3 or a variable speed motor, a fixed speed motor with a variable speed coupling to the pump or a fixed speed motor with a variable speed pump for proportional control as in FIGS. 1, 2 and 4.

The pump should be understood to be any of a fixed displacement gear pump, a fixed displacement internal gear pump, a geroter pump, piston pump, diaphragm pump, centrifugal pump, diastolic pump or any other suitable pump.

As a variation on the fixed displacement pump with a variable orifice using flow as a feedback, one might use a variable volume, pressure compensated pump with an adjustable pressure compensator and no variable volume orifice to accomplish remote positioning of the valve spool.

The controller may be a variable voltage source as described or a digital or analog controller or an electronic controller that accepts feedback from loops other than or in addition to the spool position. It could also be an electrical device such as a voltage divider or pulse width modulated control for use with AC, DC or universal motors.

The basic difference between the system of this invention and those of the prior art is that the present system is basically a flow summation of command and feedback signals. The controller causes a fixed flow from the pump. The spool feedback is accomplished by sensing a pressure drop caused by this fixed flow over an orifice that is proportional to the stroke of the valve spool.

Figure 5:
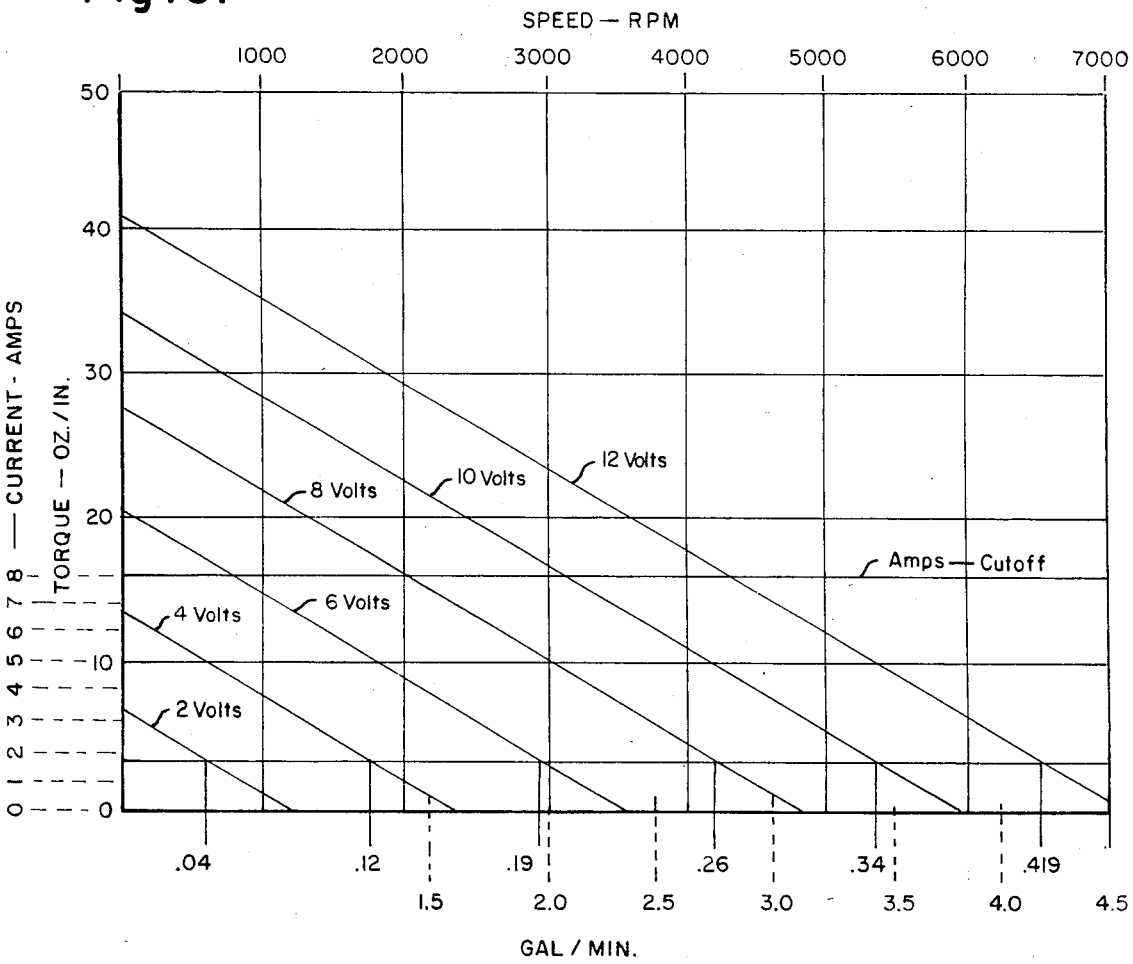
FIG. 5 is a plot showing the effective control of flow by the apparatus of this invention.

In FIG. 5, I have graphically illustrated the effective control of flow by the apparatus of this invention, using a conventional Commercial Shearing, Inc. valve of the type illustrated in FIG. 1 connected to a conventional small displacement pump and motor, a DC power source and two check valves as in FIG. 1. In the graph I have plotted speed and gal/min against torque and current for various voltage inputs to illustrate the effective feasibility of this invention.

In the foregoing specification I have set out certain preferred practices and embodiments of this invention, however, it will be understood that this invention may be otherwise embodied within the scope of the following claims.

I claim:

1. A remote positioning apparatus comprising a valve housing having a longitudinal bore therein, a pressure fluid inlet chamber intersecting said bore intermediate its ends, at least one low pressure tank chamber intersecting said bore on one side of said inlet chamber, a work chamber intersecting said bore between said inlet and tank chambers, a valve spool movable in said bore, a detent chamber at each end of said bore, resilient means in each detent chamber urging said spool to a centered position in the bore, a fluid line connecting the two detent chambers, pump means in said fluid line, drive means connected to said pump means, control means acting on said drive means to control the rotation of said drive means whereby to control the flow of fluid between said detent chambers, variable orifice means in said valve spool communicating between said at least one tank chamber and the adjacent detent chamber when said spool is moved in said bore into the detent chamber at the end of the bore opposite said variable orifice means and valve means communicating between at least one tank chamber and the detent chambers at the end of said bore.

2. A remote valve positioning apparatus as claimed in claim 1 wherein a pair of low pressure tank chambers intersect said bore, one at each side of said inlet chamber with valve means communicating between each tank chamber and the adjacent detent chamber.

3. A remote valve positioning apparatus as claimed in claim 1 or 2 wherein the variable orifice means is a tapered slot.

4. A remote valve positioning apparatus as claimed in claim 3 wherein the valve means between the tank chamber and the detent chamber is a check valve.

5. A remote valve positioning apparatus as claimed in claim 3 wherein the drive means is a variable speed electric motor.

6. A remote valve positioning apparatus as claimed in claim 1 or 2 wherein the variable orifice means is a stepped slot.

7. A remote valve positioning apparatus as claimed in claim 6 wherein the valve means between the tank chambers and detent chambers is a check valve.

8. A remote valve positioning apparatus as claimed in claim 6 wherein the drive means is an electric motor and the control means is an on/off switch.

9. A remote valve positioning apparatus as claimed in claim 1 or 2 wherein the drive means is a variable speed electric motor.

* * * * *